US006763878B1

(12) United States Patent
Marti et al.

(10) Patent No.: US 6,763,878 B1
(45) Date of Patent: Jul. 20, 2004

(54) STRIP-CASTING MACHINE WITH TWO CASTING ROLLS

(75) Inventors: Heinrich Marti, Forch (CH); Jacques Barbé , Tarantaise (FR)

(73) Assignees: SMS Demag AG and Main, Düsseldorf (DE); Management Inspiration AG, Hergiswil (CH)

( * ) Notice: Subject to any disclaimer, the term of this patent is extended or adjusted under 35 U.S.C. 154(b) by 0 days.

(21) Appl. No.: 10/088,832

(22) PCT Filed: Sep. 19, 2000

(86) PCT No.: PCT/EP00/09157

§ 371 (c)(1),
(2), (4) Date: Jun. 12, 2002

(87) PCT Pub. No.: WO01/23119

PCT Pub. Date: Apr. 5, 2001

(51) Int. Cl.[7] ..... B22D 11/06
(52) U.S. Cl. ..... 164/428; 164/480
(58) Field of Search ..... 164/480, 428, 164/479, 429

(56) References Cited

U.S. PATENT DOCUMENTS

| | | | | |
|---|---|---|---|---|
| 5,277,243 A | | 1/1994 | Fukase et al. | |
| 5,334,232 A | * | 8/1994 | France et al. | 65/388 |
| 5,753,004 A | * | 5/1998 | Hanai et al. | 75/10.14 |
| 6,152,210 A | * | 11/2000 | Baharis et al. | 164/502 |
| 6,296,046 B1 | * | 10/2001 | Jeong et al. | 164/452 |
| 6,354,365 B2 | * | 3/2002 | Capotosti et al. | 164/480 |

FOREIGN PATENT DOCUMENTS

| | | | |
|---|---|---|---|
| DE | 4307850 | | 6/1994 |
| DE | 196 17 420 C2 | | 10/1997 |
| EP | 0967032 | | 12/1999 |
| FR | 2654658 | * | 5/1991 |
| JP | 5-329583 | * | 12/1993 |

OTHER PUBLICATIONS

Patent Abstracts of Japan, vol. 018, No. 151 (M–1576), Mar. 14, 1994 & JP 05 329583 A (Mitsubishi Heavy Ind Ltd) Dec. 14, 1993.

Patent Abstracts of Japan, vol. 010, No. 388 (M–549), Dec. 25, 1986 & JP 61 176447 A (Ishikawajima Harima Heavy Ind Co Ltd.), Aug. 8, 1986.

Patent Abstracts of Japan, vol. 009, No. 311 (M–436), Dec. 7, 1985 & JP 60 145 235 A (Kaou Kueekaa KK), Jul. 31, 1985.

* cited by examiner

*Primary Examiner*—Kuang Y. Lin
(74) *Attorney, Agent, or Firm*—Friedrich Kueffner

(57) ABSTRACT

The invention relates to a strip-casting machine for producing a metal strip. Said strip-casting machine consists of a pair of casting rolls (2, 3) arranged in side-by-side parallel relation, two small faces (4) and a machine tool table (5) that supports the two casting rolls (2, 3). Said small faces (4) can be exchanged by means of a small face exchanging device. The aim of the invention is to reduce the change-over time between two castings, to improve positioning of the small faces and to heat them until start of the casting process while improving the accessibility of the casting rolls for an exchange thereof and while further allowing an optimum inerting of the plant. To this end, the small face exchanging device is configured as a support element, especially as a support arm (9) for one small face (4). Said support arm (9) and said small face (4) can be displaced in one plane from a pressing position downwards and vice versa in an essentially parallel manner and at a distance to the sealing surface of the small face (4).

22 Claims, 2 Drawing Sheets

V
V
39
40
40'
41
41'
42
42'
42"
43
44
45
46
47
48
49
50
51
52
52'
54
55
60
61
61'
70
71
72
73

STRIP-CASTING MACHINE WITH TWO CASTING ROLLS

BACKGROUND OF THE INVENTION

1. Field of the Invention

The invention pertains to a strip-casting machine with two casting rolls.

2. Description of the Related Art

It is known that twin-roll strip-casting machines can be used to produce strips continuously from a molten metal bath, especially from molten steel. The molten metal is supplied continuously in this case to the casting gap defined by two driven casting rolls. Molten metal solidifies upstream of and in the gap, and a strip which is at least partially solidified is conveyed out of the gap by the casting rolls. This strip can then be subjected to additional continuous or discontinuous operations such as cooling, reheating, hot- or cold-rolling, shaping into sections, hardening and tempering of the surface, trimming, etc.

It is also known that, in strip-casting machines with two casting rolls set up essentially parallel to each other, the casting gap can also be limited by two side plates on the roll sides. These side plates are set elastically against the end surfaces of the barrels of the two casting rolls by setting devices. The casting rolls and usually also the two setting devices for the side plates are supported on a standard. When strips are cast, especially steel strips, the side plates are worn down by abrasive wear as a result of the friction with the casting rolls and also, in the lower part, as a result of the friction with the solidified strip. When thus worn out, they must be replaced during a halt in the casting operations. To accomplish such replacement, the side plates are moved out of the casting position, in which the plates are resting against the barrels, in an essentially horizontal direction by the setting devices and thus away from the barrels and into a setting position. The plates are then moved upward from the setting position by means of small plate-changing devices, e.g., robots, which are mounted on the casting platform on each side of the machine (compare Japanese Patent Disclosure JP-5 [1993]-329,583 A). Then the side plates are set down onto a cart and brought to the side plate renovation shop. After a renovated side plate has been preheated, it is picked up by the robot and brought into the setting position from above and attached to the machine. When such robots are provided on both sides of the machine near the standard, they block access to the strip-casting machine. When the robots are set up 2–3 m away from the standard, the size and bulk of the robots increase correspondingly, and the side plates can no longer be moved into the setting position with precision. In addition, before the side plates are set down on the standard, all the supply lines such as those for heating and cooling, electric power lines, pressure media lines, etc., must be disconnected. The installation and removal of the side plates by means of robot arms, etc., requires that the robot arms have unhindered access to the side plates when they are in the setting position. This free access makes it difficult to enclose the casting machine so that an inert gas atmosphere can be created to keep oxygen from coming in contact with the steel strip and the cast strip.

Strip-casting machines with 2 casting rolls have been built with casting roll diameters of 50–1,500 mm. In strip-casting machines with a casting roll diameter of more than 800 mm, the sealing surfaces of the side plates, i.e., the surfaces which are in sliding contact with the end surfaces of the casting rolls, are also correspondingly larger. The setting devices, which press the side parts or the side plates against the casting rolls to form a seal, must also be designed to meet a higher set of requirements. All these requirements associated with casting rolls with diameters of more than 800 mm make it difficult to replace the side plates quickly and precisely.

SUMMARY OF THE INVENTION

The invention is based on the task of creating a strip-casting machine which overcomes the disadvantages of the state of the art and which in particular makes it easier to replace the side plates and thus reduces the retooling time between two casting operations. It should also be possible for the side plates to be positioned with greater accuracy and to be kept heated until casting begins. The side plates, furthermore, should also remain connected to all the supply and detector lines of the monitoring system for side plates of this type during the replacement operations. An essential secondary goal is to improve the accessibility to the casting rolls, especially when the casting rolls are to be changed, and to make it simpler to prevent oxygen from reaching the casting entry and casting exit areas of the casting machine (inertization). The problems associated with rolls with diameters of more than 800 mm and correspondingly larger side plates are also to be solved.

In accordance with the invention, the side plater can be moved downward by the carrier element in a straight line, either vertically or at an angle or along a curve. The carrier element is advantageously designed as a support arm. The support arm can swivel around an axis or move along a curve. Underneath the machine, the side plate on the support arm can be replaced with a new side plate and moved back along the same route to the setting position. It must be kept in mind that the term "setting position" includes all positions of the plate located between the casting position and the replacement position. According to an exemplary embodiment, it is possible in a first step of the operation for the support arm to shift the side plate away from the standard essentially in a horizontal direction, i.e., in the direction of the longitudinal axis of the casting rolls. This shifting of the side plate can occur along a horizontal displacement path which can be, for example, on a plane underneath the casting rolls. In a second step of the movement, the support arm with the side plate can then be shifted downward in a direction essentially parallel to the end surfaces of the casting rolls.

The displacement path can take the side plate to a side plate changing station, which is separated spatially from the casting platform by a wall. Separating the side plate station in this way makes it possible for the following work steps such as cleaning, maintenance, replacement, adjustment, preheating of the side plate, etc., to be carried out in an orderly and clean manner while also preventing accidents.

So that the strip-casting machine can be made narrow in proportion to the width of the strip, it is possible according to another exemplary embodiment for the side plate to be moved downward between the bearing journals or bearing points of the casting rolls. The side plate, with or without the setting device, can be shifted downward between the end surfaces of the roll barrels and the standard. For this purpose, the casting rolls can also be moved a certain distance apart.

The casting machine can be made especially narrow by mounting the setting and positioning devices on the standard and by making it possible for them to be connected to and disconnected from the side plates while the plates are in the setting position.

Regardless of whether the setting and positioning device can be lowered together with the side plate or the setting device remains on the standard during the replacement of the side plate, the side plate can be moved between the setting position and the casting position by the use of a pressure medium and piston-cylinder units. The plate could also be moved by electromechanical means.

After the side plate has been brought into the setting or casting position, it is possible, if desired, for the support arm to be disconnected from the side part. According to an advantageous exemplary embodiment, the support arm can remain connected to the side plate even while the plate is in the casting position.

If the side plate is shifted downward together with the setting device, that is, if the setting device is also mobile, the device requires centering and support surfaces with respect to the standard when in the setting position so that the setting forces can be introduced into the standard.

The side plate changing device consists advantageously of a support arm with a vertical carrier and a horizontal carrier, where the horizontal carrier is usually connected to a stroke device.

So that the various supply media (heating and possibly cooling media, electric power, pressurized media, etc.) for the side plates can remain connected during the shifting operation as well, it is proposed that the horizontal displacement path be provided with a drag chain for the lines of the supply media to the side plates.

To improve the seal between the rotating casting rolls and the stationary side plates, the side plates can be provided with electromagnetic coils to generate an electromagnetic field to help seal the gap.

An additional reduction in the replacement time for the side plates can be achieved by installing two side plate changing devices on each side of the casting rolls. Thus a worn-out side plate can be taken away by the one changing device while the new side plate is brought up into position by the other changing device.

BRIEF DESCRIPTION OF THE DRAWINGS

The invention is explained in greater detail below on the basis of examples.

DETAILED DESCRIPTION OF THE PREFERRED EMBODIMENTS

Figure 1:
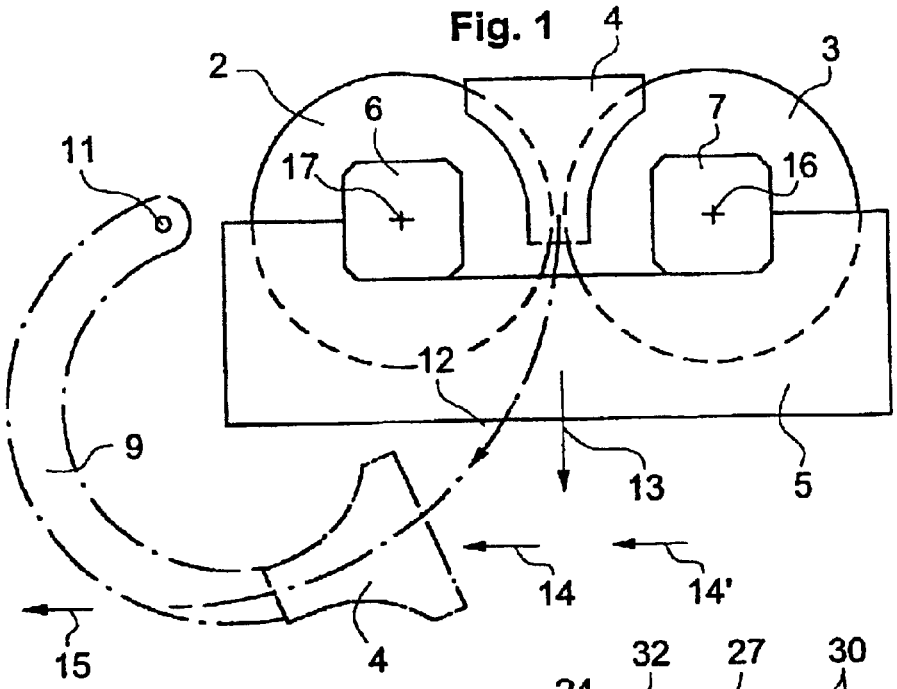
FIG. 1 shows a view of a schematic diagram of a strip-casting machine.

FIG. 1 shows a schematic diagram of a strip-casting machine, which consists of two casting rolls 2, 3, set up essentially parallel to each other; side plates 4 on the narrow sides; and a standard 5. The two casting rolls 2, 3 are carried by the roll supports 6, 7 of the standard 5. Arrows 12, 15 and arrows 13, 14 schematically indicate two different paths along which the side plate 4 can move when being replaced.

A carrier element 9, which is called a "support arm" in the present exemplary embodiment, is shown in dash-dot line. In principle, any type of design can be used, such as a crank drive, a system of articulated elements, a slideway, or the like. As the first step, the support arm can swing the side plate 4 downward around a swivel axis 11 along an arc (arrow 12). If desired, a horizontal component (arrow 15) can follow after the movement along an arc (arrow 12).

Arrow 13 shows how, as an alternative to an arc, the side plate 4 can be shifted vertically downward by a support arm (not shown in this figure). Arrow 14 indicates a horizontal displacement of the side plate 4 away from the standard 5 following the vertical movement. Arrows 14 and 15 show a direction which is transverse to the longitudinal axes 16, 17 of the casting rolls 2, 3. An arrow 14' indicates the incoming path along which a second side plate changing device carries anew side plate.

When the side plate 4 is being moved downward, it moves between the roll supports 6, 7 or bearing journals.

Figure 2:
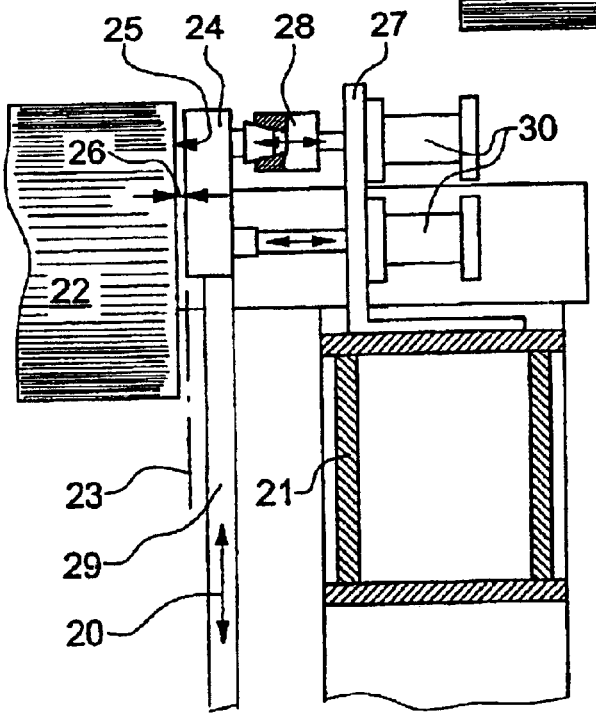
FIG. 2 shows a vertical section through an example of a strip-casting machine, only part of which is illustrated.

In FIG. 2, reference number 22 designates a casting roll, only part of which appears, and the number 24 designates a side plate in a setting position. The side plate 24 is mounted on a side plate changing device in the form of a support arm 29. When the side plate 24 is in the setting position, a gap 26 is present between it and a sealing surface 25 on the end of the roll 22. The gap 26 is closed by moving the side plate from the setting position into the casting position. For this gap-closing movement, a setting device 27, equipped with a-centering device 28 and a stroke device 30, is provided. In the example, the setting device 27 is mounted on a standard 21, and the stroke device in the form of piston-cylinder units 30 can be connected to and disconnected from the side plate 24 in the setting position. In addition, the piston-cylinder units 30 of the setting device 27 can move the side plate 24 in a controlled manner from the setting position toward the end surface (sealing surface 25) of the casting roll 22, that is, into the casting position, and also pull it back again into the setting position.

Figure 3:
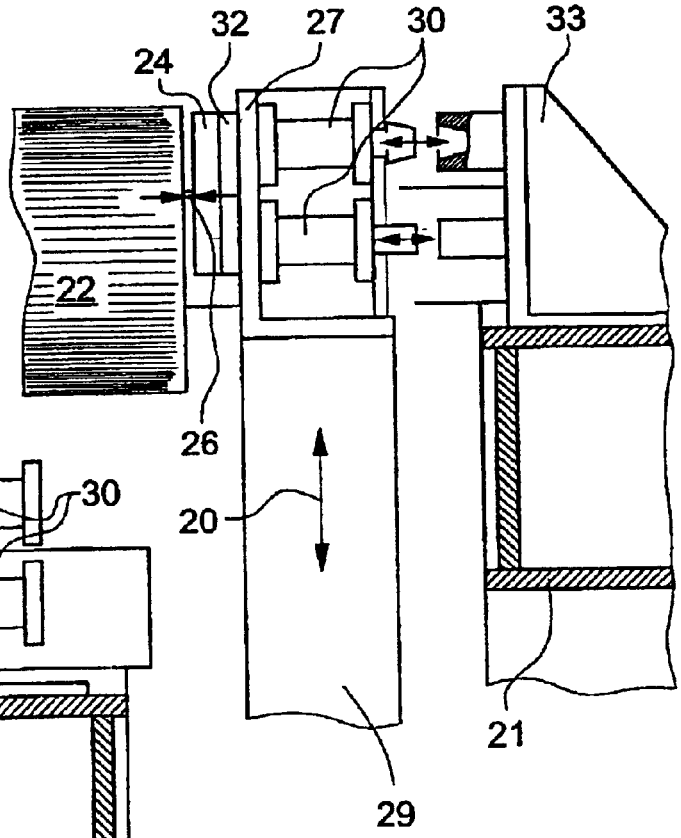
FIG. 3 shows a vertical section through another example of a strip-casting machine, only part of which is illustrated.

FIG. 3 shows both the side plate 24 and the setting device 27 on the support arm 29. The entire unit consisting of the side plate 24, the setting device 27, and the support arm 29 can move downward all together. In FIG. 3, the side plate 24 is in the setting position. By means of the stroke devices 30, the plate can be brought into the casting position, that is, into the position in which it seals the gap between it and the casting roll 22. The unit can center itself on the standard 21, and during the gap-sealing operation the standard 21 or a support part 33 can absorb the setting forces of the stroke devices 30.

Casting rolls 22 with barrels of different widths can be accommodated by the use of intermediate pieces 32, which can be inserted between the side plate and the setting device 27. As an alternative, accommodation to strip formats of different widths can be made by designing the support arm 29 so that it can be shifted or repositioned in the axial direction of the casting rolls 22.

FIGS. 2 and 3 show how the side plate 24 can be shifted downward and then back upward again between the end surfaces of the roll barrels of the casting rolls 22 and the standard 21, as shown by arrow 20. In the one figure, the plate is shifted by itself, and in the other figure it is shifted along with the setting device 27.

Figures 4, 5, 6, 7:
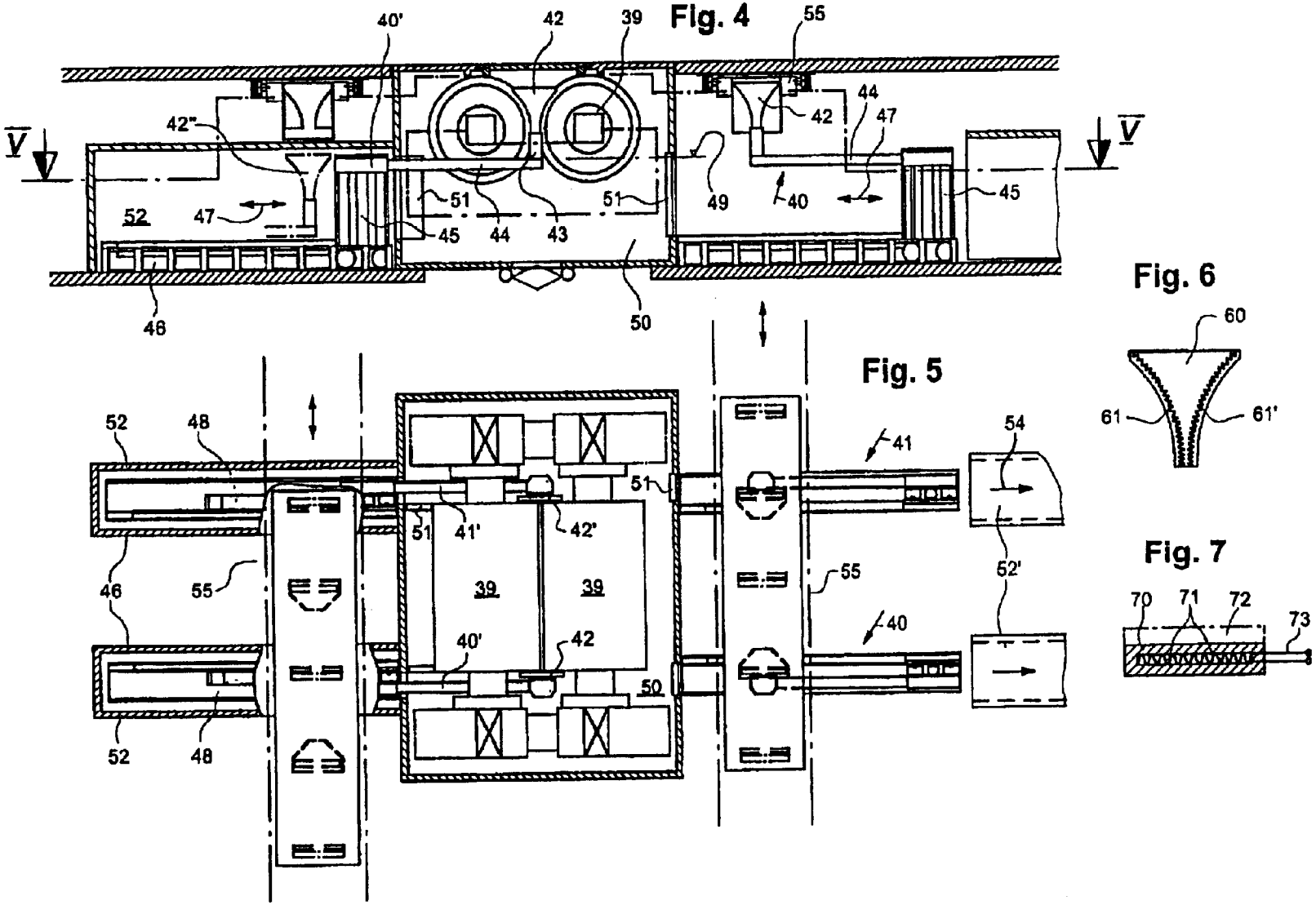
FIG. 4 shows a side view, in partial section, through the upper part of a strip-casting machine.
FIG. 5 shows a section along line V—V of FIG. 4.
FIG. 6 shows a view of a side plate.
FIG. 7 shows a horizontal section through another example of a side plate.

FIGS. 4 and 5 show an example of a strip-casting machine with two side plate changing devices 40, 40'; 41, 41' on each side of the casting machine. The side plates are designated 42, 42'. A support arm 43 consists of a vertical carrier and a horizontal carrier 44, which are attached to each other at an angle. The horizontal carrier 44 is connected at one end to a stroke device 45, which can move the support arm 43 and the side plate 42 vertically downward from the setting position. The support arm 43 with its horizontal carrier 44 can be shifted together with the stroke device 45 along the horizontal displacement path 46 in the direction of arrow 47. So that all the media supply lines for the side plate 42 can be carried along without interference during these vertical and horizontal shifts, the displacement path 46 is provided with a drag chain 48 for the supply lines. In FIG. 4, a side plate 42" is shown on the left in dash-dot line during its horizontal displacement along the displacement path 46. The side plate 42" moves here along a plane 49 underneath the bearing journals of the casting rolls 39. As a result of this horizontal displacement, the side plate can be brought out of a sealed, airtight inertization chamber 50, filled with an inert gas. It can then be brought through a closable opening 51 and into a transfer lock chamber 52, also filled with inert gas.

So that the side plate 42 can be replaced quickly, the side plate changing device 40' on the left side of the casting rolls 39 can conduct the worn-out side plate 42 away from the casting machine, and the side plate changing device 40 on the right side of the casting rolls can bring the new side plate into position. On the opposite side of the casting rolls, the side plate changing devices 41' and 41 can simultaneously replace the side plate 42' with the side plate 42. After the replacement process has been completed and the openings 51 of the inertization chamber 50 have been closed again, the transfer lock chambers 52, 52' can be moved away from the inertization chamber 50, as indicated by the arrow 54 on the right side, and the side plates 42 can be transferred to a transport device 55 mounted transversely to the displacement path 46 and sent to a holding chamber (not shown) for side plates. Instead of the removal of the transfer lock chamber 52, 52', it is also possible for the side plate changing device 40, 41 itself to move horizontally out of the transfer lock chamber 52, 52' , whereupon the side plate can be sent directly to a holding chamber, if desired.

FIG. 6 shows a schematic diagram of a side plate 60 with electromagnetic coils 61, 61'. These coils 61, 61' generate an electromagnetic field to help seal the sealing surface between the side plate 60 in the casting position and the end surfaces of the barrels of the two casting rolls and thus to prevent the escape of casting metal.

FIG. 7 shows a schematic section through a side plate 70 with an electric heating unit 71 in the interior of the side plate 70. This heating unit 71 makes it possible to heat the side plate 70 while the plate is being transported between a side plate holding chamber or a side plate preheating position and the casting position. This measure helps to reduce the idle time between two casting operations. The heating unit does not have to be installed in the side plate 70 itself, but can, for example, assume the form of an add-on device 72 (shown in dash-dot line), attached to the side plate 70.

What is claimed is:

1. A strip-casting machine comprising two casting rolls arranged parallel to each other, two side plates, and a standard for supporting the two casting rolls, wherein the two side plates are movable against the end surfaces of the casting rolls into a setting position, further comprising a side plate changing device for each side plate, wherein each side plate changing device is comprised of a carrier element for a side plate, and wherein the carrier element is movable downward together with the side plate from the setting position and back up again into the setting position, wherein the casting rolls have axes, wherein the carrier element comprises means for moving the side plate in a first step in a direction extending essentially parallel to the axes of the casting rolls and away from the end surface of the casting rolls, and wherein the carrier element comprises means for moving the side plate in a second step around a swivel axis or along a curve.

2. The strip-casting machine according to claim 1, wherein the carrier element is comprised as a support arm.

3. The strip-casting machine according to claim 1, wherein the carrier element is movable together with the side plate in a plane which extends at a certain distance from the end surfaces of the casting rolls.

4. The strip-casting machine according to claim 1, wherein the carrier element is movable together with the side plate in a plane extending essentially parallel to the end surfaces of the casting rolls.

5. The strip-casting machine according to claim 1, wherein the carrier element comprises means for moving the side plate vertically in a second step.

6. The strip-casting machine according to claim 1, wherein the carrier element comprises means for moving the side plate in an essentially horizontal direction.

7. The strip-casting machine according to claim 6, wherein the casting rolls have bearing points located on a level, further comprising a horizontal displacement path for effecting the horizontal movement of the side plate, wherein the horizontal displacement path is located approximately on a level below of the bearing points of the casting rolls.

8. The strip-casting machine according to claim 7, wherein the horizontal displacement path is configured to guide the side plate to a side plate changing station.

9. The strip-casting machine according to claim 1, wherein the side plate is movable downwardly between bearing journals of the casting rolls, wherein the casting rolls are movable a certain distance apart.

10. The strip-casting machine according to claim 1, further comprising a setting device for moving the side plate between the setting position and a casting position by means of piston-cylinder units.

11. The strip-casting machine according to claim 10 wherein the setting device is mounted on the standard and is connectable to the side plate and disconnectable from the side plate while the side plate is in the setting position.

12. The strip-casting machine according to claim 2, wherein the side plate is connected to the support arm when the plate is in the casting position.

13. The strip-casting machine according to claim 1, wherein the side plate is movable downwardly together with the setting device.

14. The strip-casting machine according to claim 1, wherein the side plate is movable downwardly between the end surfaces of the rolls and standard.

15. The strip-casting machine according to claim 2, wherein the support arm comprises a vertical portion and a horizontal portion, and wherein the horizontal portion is connected to a stroke device.

16. The strip-casting machine according to claim 1, wherein the side plates comprise electromagnetic coils for generating an electromagnetic field for sealing a roll gap.

17. The strip-casting machine according to claim 1, further comprising intermediate pieces insertable between the side plate and the setting device for accommodating casting rolls with different barrel widths.

18. The strip-casting machine according to claim 1, comprising two side plate changing devices on each side of the casting rolls, wherein a first side plate changing device is configured to carry away a worn-out side plate and a second side plate changing device is configured to supply a new side plate.

19. The strip-casting machine according to claim 2, wherein the support arm is configured to move the side plates from the setting position in an inert gas-filled chamber through a closable opening and into a transfer lock chamber.

20. The strip-casting machine according-to claim 19, wherein the side plate is movable from the transfer lock chamber by a relative movement between the side plate changing device and the transfer lock chamber, further comprising a transport device for moving the side plate to a side plate holding chamber and back from the side plate holding chamber.

21. The strip-casting machine according to claim 1, wherein the side plate comprises a heating device with a supply line, wherein the supply line remains connected to a heating medium during movement of the side plate.

22. The strip-casting machine according to claim 2, wherein the carrier element, the support arm, or the setting device are configured to accept connectable and disconnectable feed lines for coolants, for electrical or hydraulic energy, or for other media or to accept measuring and control lines for the side plate.

* * * * *